US006296532B1

(12) United States Patent
Harting et al.

(10) Patent No.: US 6,296,532 B1
(45) Date of Patent: Oct. 2, 2001

(54) ELECTRICAL CONNECTING DEVICE FOR HIGH CURRENTS

(75) Inventors: Dietmar Harting; Ludger Leve, both of Espelkamp; Jens Krause, Rahden, all of (DE)

(73) Assignee: Harting KGaA (DE)

( * ) Notice: Subject to any disclaimer, the term of this patent is extended or adjusted under 35 U.S.C. 154(b) by 0 days.

(21) Appl. No.: 09/460,859

(22) Filed: Dec. 14, 1999

(30) Foreign Application Priority Data

Dec. 21, 1998 (DE) ..... 198 59 196

(51) Int. Cl.[7] ..... H01R 4/50
(52) U.S. Cl. ..... 439/807; 483/783; 483/863
(58) Field of Search ..... 439/783, 794, 439/807, 863

(56) References Cited

U.S. PATENT DOCUMENTS 3,891,297 * 6/1975 Poliak et al. ..... 339/270
5,795,195 8/1998 Karlsberger .

FOREIGN PATENT DOCUMENTS 331 499 1/1921 (DE) .
12 41 887 6/1967 (DE) .
90 07 120 U1 11/1990 (DE) .
197 43 867 C1 4/1999 (DE) .
535 862 4/1922 (FR) .
1 038 086 9/1953 (FR) .

* cited by examiner

*Primary Examiner*—Paula Bradley
*Assistant Examiner*—Truc Nguyen
(74) *Attorney, Agent, or Firm*—Cook, Alex, McFarron, Manzo, Cummings & Mehler, Ltd.

(57) ABSTRACT

A connecting device (10) for detachably connecting an electrical conductor (12) for high currents which is disposed therein, to an electrical contact (14) is characterized in that at least one wedging face (44) is provided, by means of which the electrical conductor (12) can be loaded against the contact (14).

5 Claims, 4 Drawing Sheets

ELECTRICAL CONNECTING DEVICE FOR HIGH CURRENTS

The invention relates to a connecting device for detachably connecting an electrical conductor for high currents which is disposed therein, to at least one electrical contact. The invention also relates to a structural assembly consisting of a connecting device of this kind and a contact.

Connecting devices of this kind are particularly known in the field of motor vehicle engineering. They serve for connecting, for example, a generator or a starter. The currents to be transmitted under those circumstances reach an order of magnitude of 100 A or more.

Very recently, consideration has been given to combining the starter and the generator to form one integrated component. At the same time, the idea is being contemplated of driving various structural assemblies, which are currently driven mechanically direct from the engine, electrically in future so as to be able to have driving power which is matched to the particular requirements, freely available. With respect to the integrated starter/generator power which is then needed, connecting devices are required which are capable of transmitting currents up to the order of magnitude of 400 A. At the same time, it is desirable for the connecting device to be detachable, so that the outlay during assembly or in the event of replacement of the integrated starter/generator remains as small as possible.

The object of the invention thus consists in providing a connecting device with which the high currents supplied can be reliably transmitted, even over a period of years, and which requires little outlay for connection purposes.

To this end there is provided, in a connecting device of the kind initially mentioned, at least one wedging face by means of which the electrical conductor can be loaded against the contact. In the connecting device according to the invention, the wedging face has a double function: On the one hand, the said wedging face makes it possible to supply suitably high forces by means of which the electrical conductor can be pressed against the contact. These high forces guarantee a reliable electrical connection between the electrical conductor and the contact, so that the high currents required can be transmitted with the desired reliability, even over a period of years. On the other hand, the wedging face opens up the possibility of severing the connection again, through the fact that the forces which press the electrical conductor against the contact are abolished by means of suitable relative displacement.

According to one preferred form of embodiment of the invention, provision is made for the wedging face to be part of a wedge which rests against a supporting face on the connecting device. The wedge, which can be brought into the desired position by hand, for example, or even by a screw, makes it possible to set very precisely the force acting between the electrical conductor and the contact. The higher the desired force, the further forwards the wedge is moved.

According to another preferred form of embodiment of the invention, provision is made for the wedging face to be part of a gripping jaw which rests against a supporting face on the connecting device. Two gripping jaws which lie opposite one another and constitute part of the electrical conductor, and between which the contact can be disposed, are preferably provided. The gripping jaws thus engage around the contact from two sides and lead to a reliable electrical connection. The said gripping jaws can be automatically brought by the wedging faces, for example during assembly of the connecting device, into the position in which they act firmly on the contact.

According to one preferred form of embodiment of the invention, a spring is provided, by means of which the electrical conductor can be loaded against the contact. A spring of this kind guarantees, on the one hand, that the desired high forces between the electrical conductor and the contact are reliably reached and adhered to. Minor tolerances can be compensated for by the spring, the active force of the latter changing only slightly. On the other hand, the spring makes it possible to offset creepage and settlement phenomena between the connecting device and the contact. Any creepage and settlement phenomena then merely lead to a slight decline in the active force, which decline is not critical.

According to one form of embodiment of the invention, provision is made for the spring to be formed by a portion of the electrical conductor having an arcuate cross-section. In this refinement, no additional component supplying the desired spring action is required. Assuming that the electrical conductor has the material properties required for the spring action, a spring which is able to apply the high contact forces desired is formed in this way. If the contact has a flat contact face, the conductor portion with the arcuate cross-section rests against the said contact face by means of its outer edges. In this way, the electrical connection between the contact and the electrical conductor is achieved in precisely defined face regions. In conjunction with the appropriately chosen spring force, a precisely defined surface pressure, which guarantees reliable electrical connection between the conductor and contact, is achieved in the said regions.

According to another form of embodiment, provision is made for the spring to be a resilient lamella which can be disposed between the electrical conductor and the contact. In this way, it is guaranteed that the electrical connection from the conductor to the resilient lamella and then from the resilient lamella to the contact is produced only in precisely defined face regions. The surface pressure required for a reliable electrical connection is then produced in the connecting regions, in conjunction with the spring force predetermined by the resilient lamella.

Provision is preferably made for the contact to have a flat contact face, and the electrical conductor a flat conductive face, and for the resilient lamella to be disposed between the contact face and the conductive face. This refinement is distinguished by a low overall outlay. The electrical conductor merely has to be of flat configuration on one side as the conductive face, for example as a result of milling-off or flat pressing, and the resilient lamella is disposed between the electrical conductor and the contact before these two parts are joined together. In the final joining-together operation, the wedging face ensures that the electrical conductor and the contact are loaded against one another in a suitable manner, the said resilient lamella absorbing any tolerances and ensuring the necessary surface pressure between the electrical conductor and the resilient lamella and also between the resilient lamella and the contact.

Advantageous refinements of the invention emerge from the subclaims.

The invention will be described below with reference to various forms of embodiment which are represented in the accompanying drawings, in which.

Figure 1:
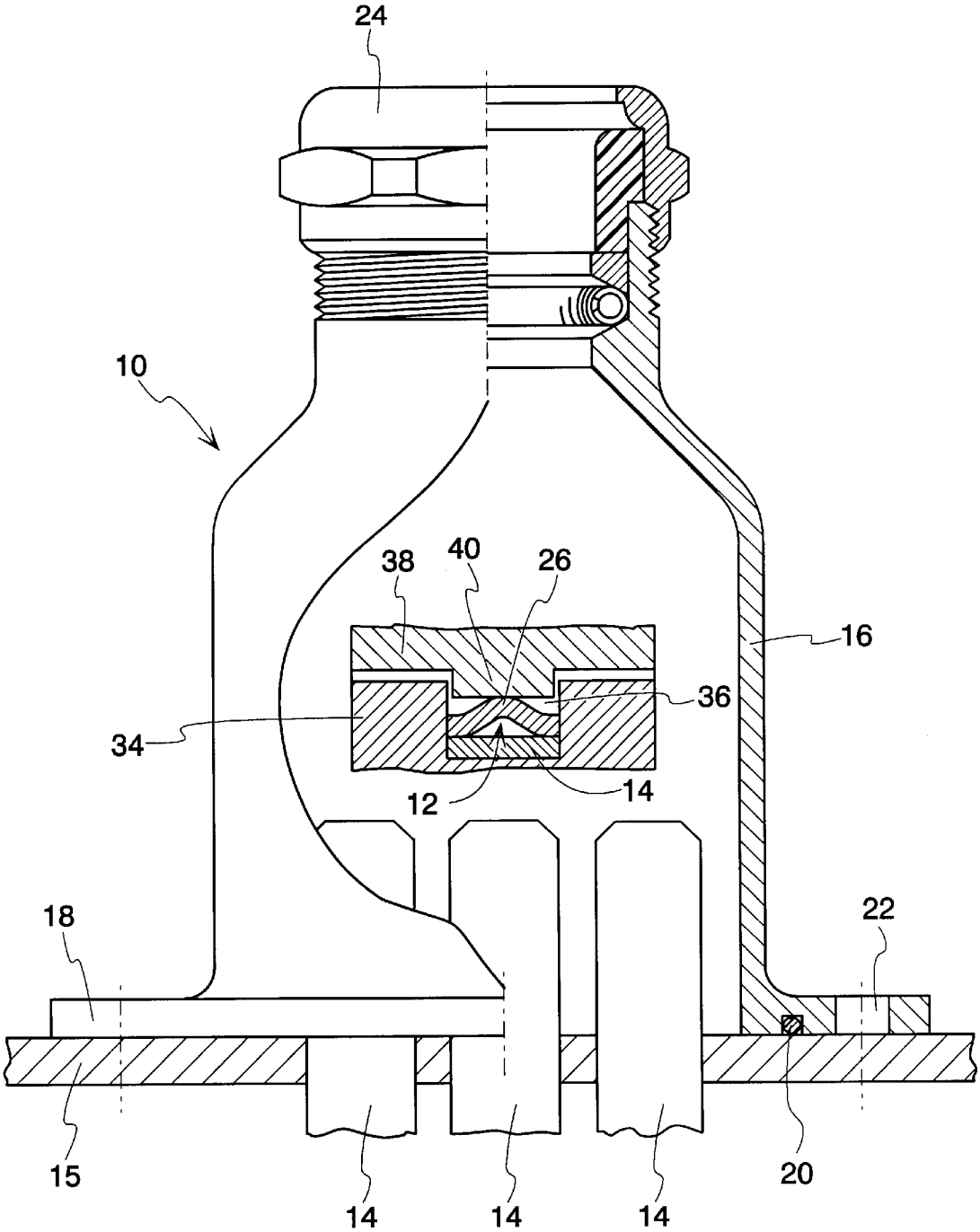
FIG. 1 shows, in a side view with broken-away portions, a connecting device according to the invention with contact according to a first form of embodiment.
Figure 2:
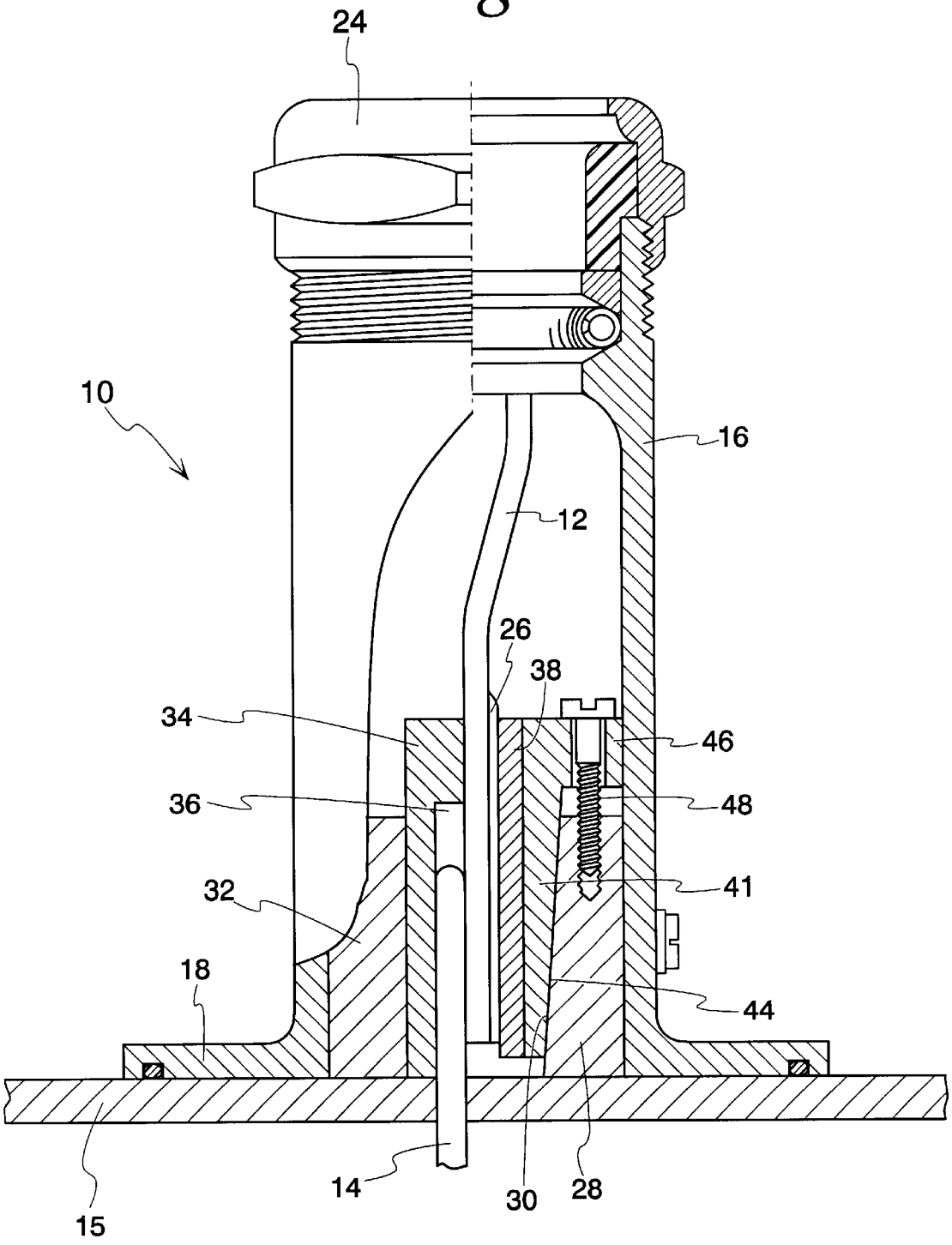
FIG. 2 shows, in another diagrammatic side view with broken-away portions, the connecting device with contacts from FIG. 1.

FIGS. 1 and 2 show a connecting device 10 according to a first form of embodiment of the invention. The connecting device serves to connect a number of electrical conductors 12, of which only one is shown here, to an appertaining contact 14 in each case in an electrically conductive manner. The contacts 14 may, for example, be part of an integrated starter/generator, and the connecting device 10 serves to connect the electrical conductors 12 reliably and detachably to the contacts 14.

The connecting device 10 has a housing 16 which is provided with a fastening flange 18. The said fastening flange 18 serves to fasten the connecting device to, for example, the housing 15 of the integrated starter/generator. An O-ring 20 is provided on the fastening flange 18 as a seal. The fastening flange is also provided with a number of fastening bores 22 by means of which the housing 16 of the connecting device 10 can be screwed tight in such a way that the contacts 14 project into the interior of the housing 16. The housing 16 is also provided with a screwed connection 24 which makes it possible to seal off the housing 16 at the point at which the electrical conductors 12 pass out of the said housing. A tension-relieving system may also be constructed at this point.

The electrical conductors 12, which have a cross-section in the order of magnitude of 50 mm2 because of the electrical currents to be transmitted, are preferably constructed as solid conductors with a rectangular cross-section. At the lower end, the electrical conductor 12 has a portion 26 which is constructed with an arcuate cross-section (see, in particular, the sectional drawing contained in FIG. 1).

Disposed in the interior of the housing is a supporting element 28 which is provided with a supporting face 30 running obliquely to the longitudinal direction of the connecting device. The supporting face 30 lies opposite an opposed bearing part 32 at a distance from the latter.

Resting against the opposed bearing part 32 is a receiving part 34 which is provided with a recess 36. One of the contacts 14 is disposed in the said recess. The conductor portion 26 with an arcuate cross-section also extends into the recess 36. The said conductor portion 26 rests, by means of its outer edges which extend in the longitudinal direction, against the contact 14. Resting against the conductor portion 26, on that side of the latter which faces away from the contact 14, is a pressure part 38 which is provided with an extension 40 that engages in the recess 36 in the receiving part 34, so that the said receiving part and the pressure part cannot become displaced in relation to one another. Finally, a wedge 41, which is provided with a wedging face 44 that rests against the supporting face 30 on the supporting part 28, rests against that side of the pressure part 38 which faces away from the extension 40. The wedge 41 is provided with an adjusting extension 46 on which the head of an adjusting screw 48 rests. The adjusting screw 48 can be screwed into a bore in the supporting part 28.

In order to achieve the desired severable connection between the contact 14 and the electrical conductor 12, the said contact 14 and that conductor portion 26 of the electrical conductor 12 which has the arcuate cross-section are laid in the recess 36 in the receiving part 34. The pressure part 38 is then placed in position. Finally, the wedge 41 is pressed between the pressure part 38 and the supporting face 30 of the supporting part 28. In the process, the relative movement between the wedge 41 and the supporting part 28 is converted, because of the wedging and supporting faces, into a force which presses the conductor portion 26 against the contact 14. Because of the arcuate cross-section of the conductor portion 26, the latter acts as a spring which, with increasing deformation, exerts a growing spring force on the contact 14. The wedge can be driven in by means of the adjusting screw 48 until it reaches the desired position between the supporting part 28 and the pressure part 38. This position is determined by the desired force between the conductor portion 26 and the contact 14. It depends upon the surface pressure which is to be achieved between the longitudinal edges of the conductor portion 26 and the contact 14, so that a reliable electrical connection between the conductor 12 and the said contact 14 is guaranteed. Under these circumstances, the conductor portion 26 is designed in such a way that this desired surface pressure is reached only when a certain deformation of the cross-section of the conductor portion 26, which cross-section acts as a spring, occurs. That is to say, in this case the spring property of the conductor portion 26 makes it possible to offset, within certain limits, tolerances and also creepage and settlement phenomena that occur in all the components involved, without this substantially influencing the force acting between the contact 14 and the conductor portion 26, and therefore the surface pressure. The connecting device according to the invention thus guarantees good contact-making, even over a long period of time.

If the connection between the electrical supply 12 and the contact 14 is to be severed, all that is necessary is to undo the adjusting screw 48. The wedge 41 can then be drawn out, so that the connection is severed.

According to a further development of the invention which is not represented, the conductor portion 26 can also be constructed with a rectangular cross-section. The spring force between the conductor portion 26 and the contact 14 can then be supplied by a resilient lamella disposed between the said two parts. The said resilient lamella has, after the fashion of a locking washer, obliquely set, resilient platelets which, on the one hand, supply the desired spring force between the conductor portion 26 and the contact 14 and, on the other hand, permit contact between the conductor portion 26 and the resilient lamella and also between the resilient lamella and the contact 14 only in precisely defined face regions, so that, in conjunction with the spring forces predetermined by the design, a precisely defined surface pressure at the points of contact is achieved. This surface pressure then guarantees reliable contact-making.

Attention is drawn to the fact that the contacts 14 do not necessarily need to be flat on their contact faces, nor the electrical conductor on its conductive face. Basically, it is also conceivably possible for the faces which are coordinated with one another to be of curved design in some way, a correspondingly curved resilient lamella, for example, then being used between the said parts.

Figure 3:
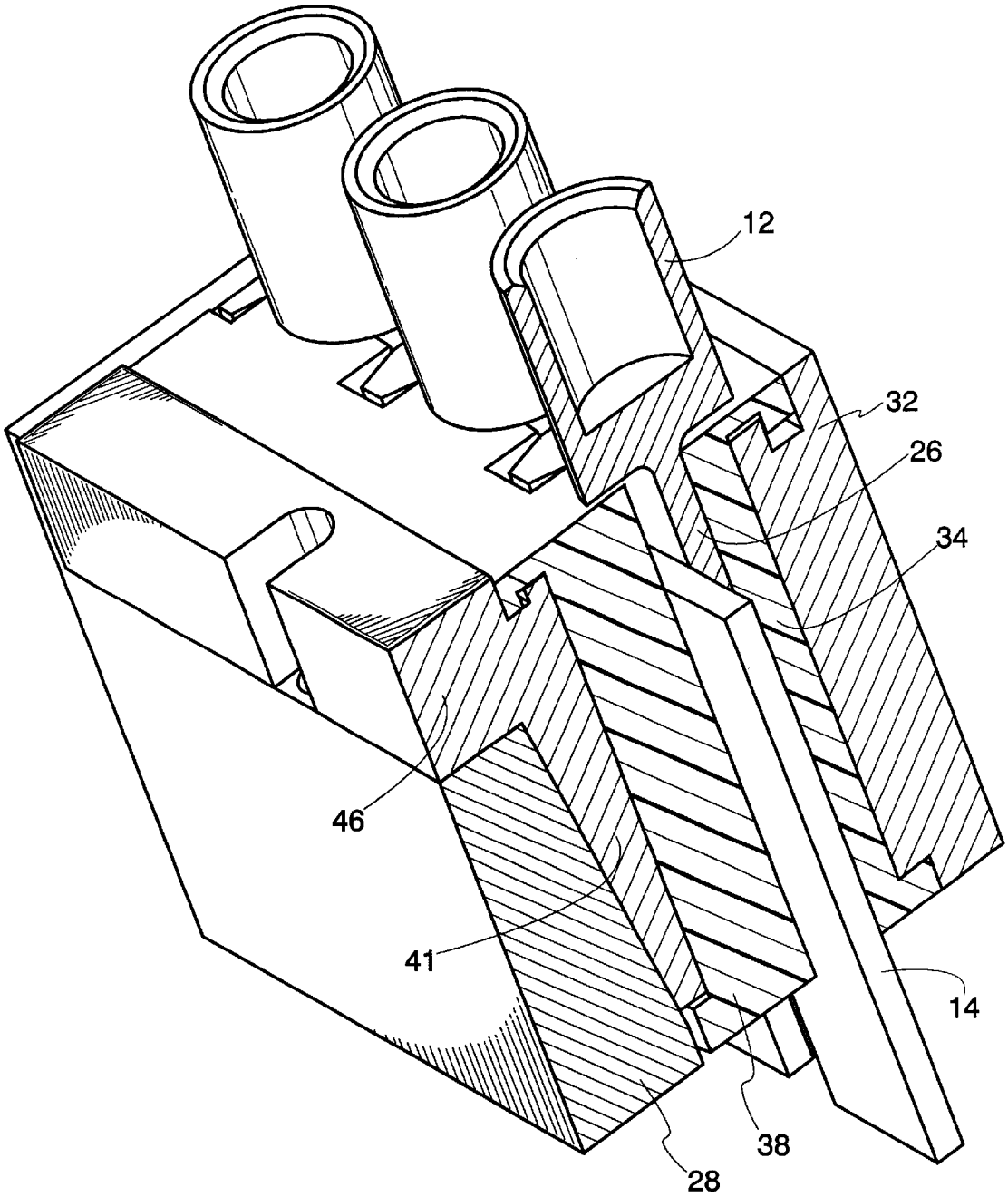
FIG. 3 shows, in a cut-away perspective view, a connecting device according to the invention with contacts according to a second form of embodiment.

FIG. 3 shows a connecting device according to a second form of embodiment. Here, the same reference symbols are used for the components which are known from FIGS. 1 and 2.

In this form of embodiment, too, use is made of a wedge 41 which supplies a force by means of which the conductor portion 26 of the conductor 12 and the contact 14 are pressed against one another between the pressure part 38 and a receiving part 34. In the same way as in the first form of embodiment, both the pressure part and also the receiving part are made of an electrically insulating material.

In this form of embodiment, the pressure part 38 is fixedly attached to the wedge 41. The receiving part 34 is fixedly attached to the opposed bearing part 32 in the same way. Finally, the adjusting extension 46 on the wedge 41 is configured in such a way that it predetermines the final location of the wedge 41 as a result of abutment against the upper side of the supporting part 28. In this form of embodiment, no springs are provided.

The spring action is obtained as a result of the inherent elasticity of the pressure part and of the receiving part, and also of the prestressing of the said two parts which is achieved when the wedge is pressed in.

In the second form of embodiment, the electrical connections 12 are designed as sockets, so that connection to a solid conductor, which is guided into the housing 16 through the screwed connection 24, is possible.

Figure 4:
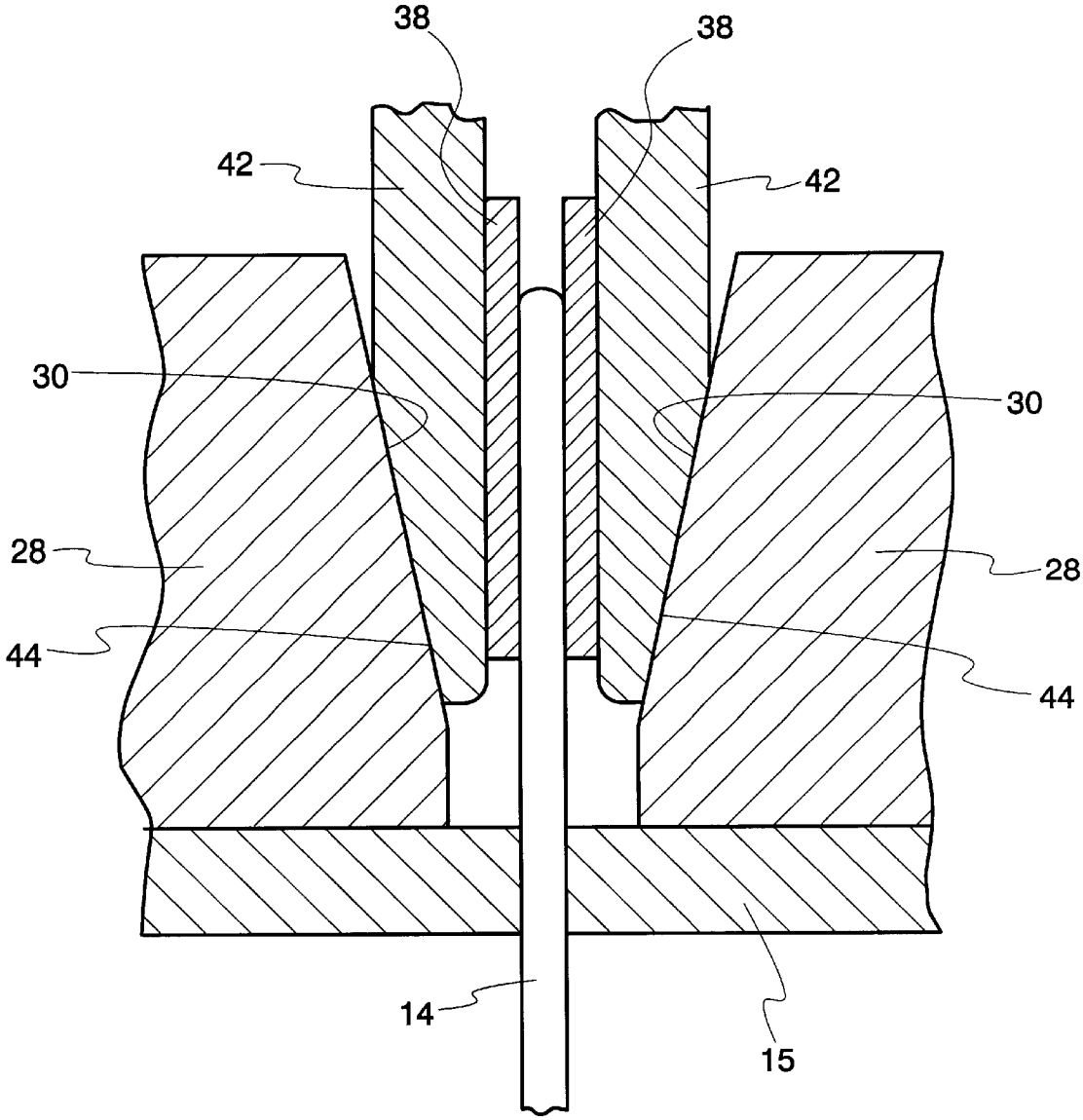
FIG. 4 shows, in a diagrammatic, truncated cross-sectional view, part of a connecting device according to the invention with contact according to a third form of embodiment.

FIG. 4 shows diagrammatically part of a connecting device according to a third form of embodiment. The contact 14, which protrudes out of a housing 15 belonging, for example, to an integrated starter/generator, is disposed between two gripping jaws 42 in this form of embodiment. Each gripping jaw 42 has a wedging face 44 which rests against a supporting face 30 on a supporting part 28.

Disposed between the gripping jaws 42 and the contact 14 are two pressure parts 38 which may be constructed, for example, as resilient lamellae.

During assembly, the gripping jaws 42 are displaced, relative to the supporting parts 28, in such a way that the desired pressure is exerted on the contact 14 via the wedging faces 44.

What is claimed is:

1. A connecting device (10) for detachably connecting an electrical conductor (12) for high currents which is disposed therein, to an electrical contact (14), a housing of said connecting device having a supporting element (28) and a bearing part (32) positioned therein and disposed on opposite sides thereof, a receiving part (34) being disposed between the supporting element and the bearing part and being engageable with the contact (14), characterized in that at least one wedging face (44) is provided, the wedging face (44) being part of a wedge (41) which rests against a supporting face (30) on the connecting device (10), movement by the wedging face capable of supplying wedging force to the electrical conductor (12), and a spring which allows the electrical conductor (12) to be loadable against the contact (14).

2. The connecting device according to claim 1, characterized in that the wedging face (44) is part of a gripping jaw (42) which rests against a supporting face (30) on the connecting device (10).

3. The connecting device according to claim 2, characterized in that two gripping jaws (42) are provided, which lie opposite one another and constitute part of the electrical conductor (12), and between which the contact (14) can be disposed.

4. The connecting device according to claim 1, characterized in that the spring is formed by a portion (26) of the electrical conductor (12) having an arcuate cross-section.

5. The structural assembly according to claim 4 characterized in that the contact (14) has a flat contact face contacting a backside of the conductor portion (26) of the conductor (12) having an arcuate cross-section.

* * * * *